US005242380A

United States Patent [19]

Steinbrueck

[11] Patent Number: 5,242,380

[45] Date of Patent: Sep. 7, 1993

[54] ORTHOPEDIC UNDER-ARM BACK HARNESS

[76] Inventor: Herbert L. Steinbrueck, 313 Ashley Ct., Pharr, Tex. 78577

[21] Appl. No.: 805,017

[22] Filed: Dec. 11, 1991

[51] Int. Cl.[5] ..... A61H 1/02

[52] U.S. Cl. ..... 602/32; 602/36; 606/241; 482/43

[58] Field of Search ..... 602/32, 34, 36, 19; 128/75, 78; 606/241; 482/43, 144, 69; 182/3; 244/151 R

[56] References Cited

U.S. PATENT DOCUMENTS

| | | | |
|---|---|---|---|
| 30,601 | 11/1860 | Wright . | |
| 1,080,2979 | 12/1913 | Pitts et al. | 606/241 |
| 1,116,773 | 11/1914 | West et al. . | |
| 1,347,913 | 7/1920 | Rink | 602/32 |
| 2,699,284 | 1/1955 | Rose | 182/3 |
| 3,420,230 | 1/1969 | Ballard | 602/36 |
| 3,761,082 | 9/1973 | Barthel, Jr. | 244/151 R |
| 3,827,429 | 8/1974 | Heikes | 602/36 |
| 4,194,500 | 3/1980 | Grimaldi . | |
| 4,254,763 | 3/1981 | McCready et al. . | |
| 4,269,179 | 5/1981 | Burton et al. . | |
| 4,603,689 | 8/1986 | Horner . | |
| 4,632,099 | 12/1986 | Mollo . | |
| 4,676,418 | 6/1987 | Lowe | 224/262 |
| 4,722,329 | 2/1988 | Kalvag . | |
| 4,907,575 | 3/1990 | Satterthwaite | 602/19 |
| 4,991,572 | 2/1991 | Chases . | |
| 5,033,460 | 7/1991 | Goldish . | |

FOREIGN PATENT DOCUMENTS

| | | | |
|---|---|---|---|
| 620507 | 5/1961 | Canada | 128/78 |

*Primary Examiner*—Richard J. Apley
*Assistant Examiner*—Jeanne M. Mollo
*Attorney, Agent, or Firm*—Robbins & Robbins

[57] ABSTRACT

An orthopedic back harness is provided for alleviating muscle and back pains. The harness is comprised of a wide flexible belts having some degree of stiffness and substantial padding. The belt is fitted above the breast and under the arm pits of the user in such a manner that when connected to an elevated support, such as a ceiling, the weight of the user is borne by the belt and pads under the arms at the arm pit area. Padding sections on the belt provide a thickness such that the user can support upper portions of the arms on the belt to share the body load upon the back. A second belt may be fitted around the waist of the user and connected to the upper wide belt by flexible straps to share the weight load of the user. When the body of the user is fully supported by the aforementioned belts, strain and tension on the back and back muscles can be used to alleviate back and back muscle pains and soreness.

6 Claims, 1 Drawing Sheet

ORTHOPEDIC UNDER-ARM BACK HARNESS

BACKGROUND OF THE INVENTION

In the past many people have been plagued with sore or aching backs or back muscles. Many of these symptoms may be occasioned by sprains of one type or another that may be alleviated by the passage of time, medical treatment or the like where not serious enough to occasion surgical treatment as a last resort.

Various types of orthopedic back harnesses of one type or another have been devised to provide traction to ease the pain and suffering of the user. Such harnesses have taken the form of devices for stretching the body in one fashion or another. The support of the body by a chest or waist harness form an elevated support has been another manner of stretching the body by gravity. Such harnesses have in general caused ultimate discomfort by constriction about the chest and breast which is particularly uncomfortable for females.

There has remained a problem in providing alleviation or ease of pain and suffering by individuals suffering from back problems of one type or another.

SUMMARY OF THE INVENTION

By means of this invention, there has been provided an orthopedic back harness which may be readily employed by a user to ease the pain occasioned by sore back muscles or back misalignment. The harness is designed to support the body by gravity from an elevated support in a manner where the full weight of the body is borne by the harness.

The harness has a wide under the arm belt designed to fit around the upper portion of the chest above the breast and under the arm pit whereby the upper portion of the chest, the shoulders and the upper arm all contribute to share the weight of the body and lessen the strain of a solely chest support harness which may cause chest constriction. Further, constriction of the chest and breast which may cause discomfort to females is avoided.

The harness may also employ a waist belt which is fitted around the waist of the user. The waist belt is connected by straps to the wide upper belt to provide additional support for the body and share the load upon the upper belt. By the provision of the two belts, the user may support his body from the elevated support for as long as desired without undue constriction about the chest and breast.

The harness is designed to provide the wide belt with sufficient flexibility to fit around the body but a degree of stiffness to furnish support under the arm pits and upper arm portion under the shoulder so that a portion of the body load may be shared with the shoulder and upper arm adjacent the shoulder. The belt has extensive padding to lessen chafing and also to provide support under the arm pit and the upper arm.

The orthopedic harness is rugged and simply employed by users, male and female. It provides a device that can be used in the home effectively and readily to ease the suffering occasioned by aches and pains associated with sore back muscles and backs.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
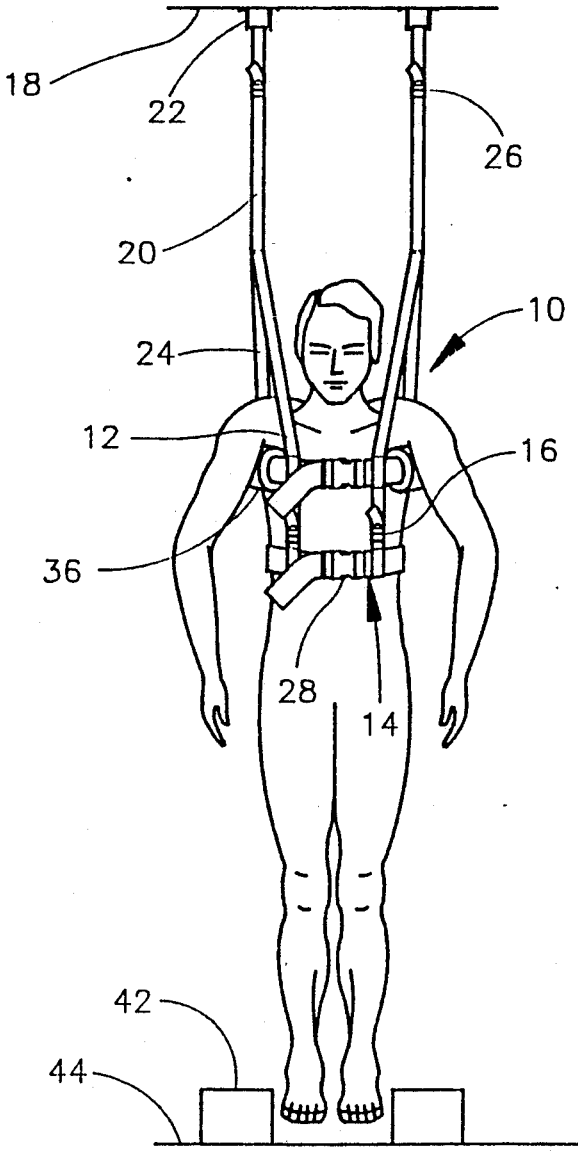
FIG. 1 is a view in front elevation showing the harness in use.
Figure 2:
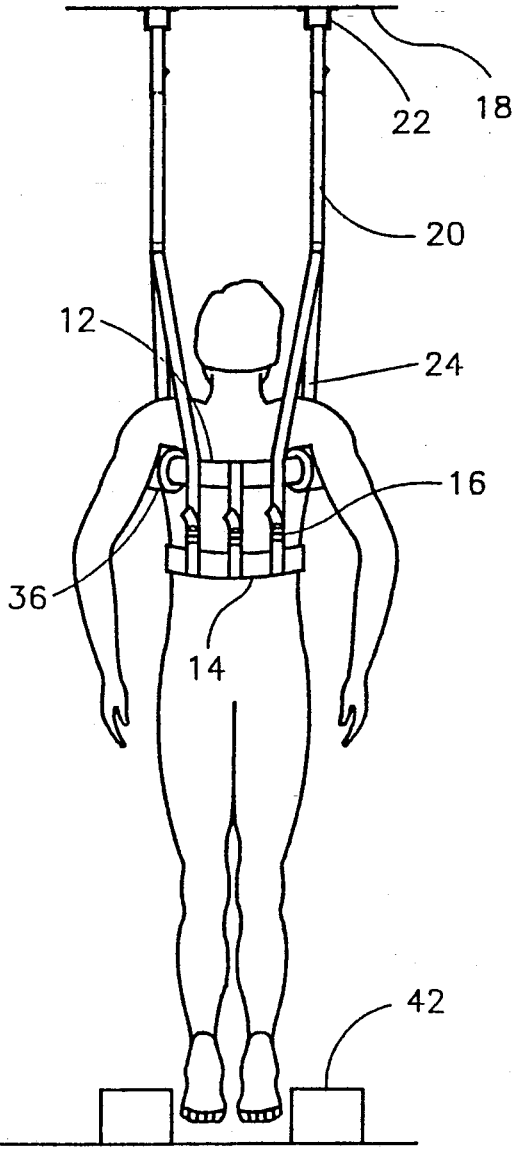
FIG. 2 is a view similar to FIG. 1 but in rear elevation.

The orthopedic back harness is generally indicated by the reference numeral 10 in FIGS. 1 and 2. It is comprised of an upper wide underarm belt 12 and a lower waist belt 14. Flexible straps 16 of nylon or the like fitting on opposite sides of the breasts of the user connect the belts.

In order to provide for suspension of the user's body from an elevated support such as a ceiling 18 or the like, suspension straps 20 adapted to be supported by brackets 22 are employed. The straps are of a suitable material of construction such as nylon or the like. Each of the straps are bifurcated with a pair of shoulder extensions 24 connected to the front and rear of the upper belt 12. Conventional strap adjustments 26 are used to take up or give out slack for size adjustment for users of different heights.

The lower waist belt may be made of suitable flexible material, such as hard rubber, leather, plastic, nylon or the like. It may be of the same material of construction as the upper belt 12 without the padding.

Figure 4:
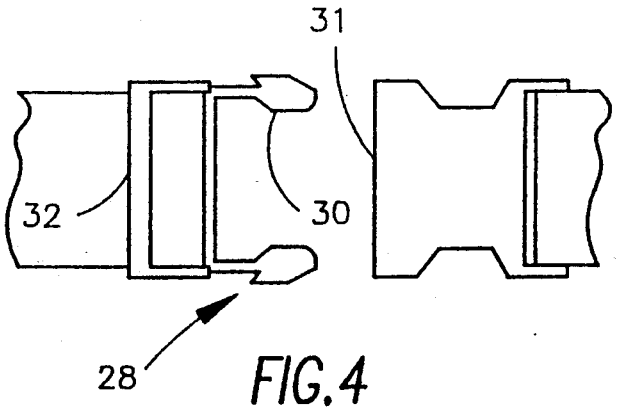
FIG. 4 is an enlarged fragmentary top plan view showing the quick release buckle.

In order to provide for quick release of the waist belt 14 and the belt 12 conventional quick release buckles 28 as shown in FIGS. 1 and 4 are provided having a male portion 30 and an interfitting female portion 31 with a release 32. Such buckles are conventional in construction and form no part of this invention, per se. If desired, the belts may be split in the back and provided with Velcro pads (not shown) for size adjustment and easy connection. The Velcro-like pads provide sufficient holding power when engaged together to resist accidental separation but can be easily pulled apart when desired to be disengaged. The pads are used in mating relation with one pad comprising a large number of closely spaced hooking elements of flexible resilient plastic and the mating pad having a greater number of flexible loops of a resilient material. They are described in U.S. Pat. Nos. 2,717,437; 3,000,384 and 3,009,235 and form no part of this invention, per se.

Figure 3:
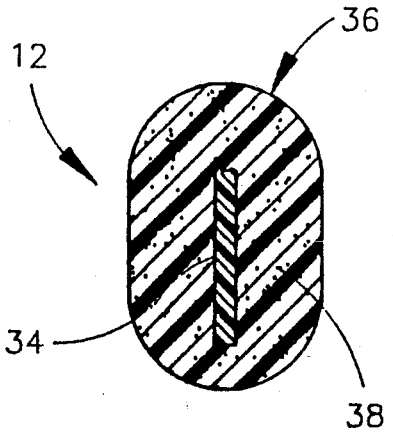
FIG. 3 is an enlarged view in vertical section showing the padding construction of the underarm harness portion.

The upper under the arm wide belt is shown in cross-section in FIG. 3. It is comprised of a strong longitudinally flexible belt core portion 34 having a relative lateral stiffness such as provided in industrial belting and wide motorcycle rider belts. This may be made of hard rubber, leather, plastic or standard composition employed in such industrial belting.

In order to provide padding and thickness to extend the belt laterally under the arm pit, shoulder and upper arm for support of these members, padding 36 is provided. This padding, as an example, is a formed foam pad 38 of rubber (which may be natural or synthetic) and is formed over the belt core portion 34. The foam rubber padding provides a strong wide comfortable support over the core portion 34 upon which the user may be supported while using the upper arm and shoulder to raise and lower the body upon the upper belt to tension or relax the body within the harness in response to any pain in the back muscles and back.

USE OF THE INVENTION

The harness is readily employed by the user by suspending the support straps from the ceiling brackets 22 while the user is standing on supports such as boxes 42 of appropriate heights on a floor 44. The user then slips on the harness to the positions shown in FIGS. 1 and 2 while adjusting the straps and belts as desired.

After the user is firmly supported within the harness with the padding 36 of the upper under the arm wide belt 12 positioned under the arm pits, the user may step off the boxes. This position shown in FIGS. 1 and 2 places the user with the full weight of the body upon the harness with the feet dangling between the boxes. The user may stay in this position a matter of seconds or minutes as desired to obtain the desired relief. In the fully supported position, the user may raise and lower the arms and shoulders using the padding portion as a fulcrum to provide light exercise and vary the strain upon the back muscles and back as desired.

With use, the user may develop his own regimen for support by use of the upper belt and support from the shoulder and arms. With such use, the lower waist belt may be disconnected in some cases and only the upper belt employed. In either case, the positioning of the belts provides for usage with comfort and effectiveness and avoids unpleasant constriction of the breast areas.

After use, the user may step on the boxes and disconnect the belts by releasing the quick release buckles. In an emergency, the quick release buckles may be disconnected while the user is still supported by the harness which provides a desirable safety feature.

Various changes and modifications may be made within this invention as will be apparent to those skilled in the art. Such changes and modifications are within the scope and teaching of this invention as defined in the claims appended hereto.

What is claimed is:

1. An orthopedic back harness for relieving back strain by suspending the body of the user by gravity vertically from an elevated fixed support above the user, sad harness comprising a wide belt fitting under arm pits of the user and above the breast, said belt having padding means extending under the upper arms of the user, said padding means consisting of integral padding and having sufficient thickness and being positioned to bear support of said arms thereon when said upper arms are moved up and down and means for supporting the body consisting of a pair of support straps connected to the front and back of said wide belt for connection to said elevated fixed support, said support straps extending in substantially parallel relation to each other to be spaced apart at separate fixed support members comprising said elevated fixed support and said support means further consisting of a waist belt connected to the front and back of said wide belt in vertical load bearing relation by a pair of flexible straps being held in a taut relationship on opposite sides of breasts of the user to said wide belt for sharing the vertical weight load of the user with said support straps.

2. The back harness of claim 1 in which a quick release buckle and adjustment is provided for said wide belt and said waist belt.

3. The back harness of claim 1 in which said padding extends laterally under a portion of the upper arms of the user a sufficient distance that the user may support a portion of his weight upon the padding by raising and lowering his arms.

4. The back harness of claim 1 in which a quick release buckle and adjustment is provided for said wide belt and said waist belt.

5. The back harness of claim 4 in which said padding is provided by a pair of padding sections on opposed sides of said wide belt under the arm pits of the user.

6. The back harness of claim 5 in which said padding is comprised of foam rubber of sufficient thickness for support of the upper arms, said foam rubber enclosing a portion of said wide belt.

* * * * *